US008870392B2

(12) United States Patent
Kleinert et al.

(10) Patent No.: US 8,870,392 B2
(45) Date of Patent: Oct. 28, 2014

(54) PROJECTOR AND HOUSEHOLD APPLIANCE COMPRISING SUCH A PROJECTOR

(75) Inventors: Oliver Kleinert, Fuerstenfeldbruck (SE); Honghua (Terry) Hu, Stockholm (SE); Franz-Josef Wipperfurth, Cadolzburg (DE); Werner Braun, Georgensgmund (DE)

(73) Assignee: Electrolux Home Products Corporation N.V., Brussels (BE)

( * ) Notice: Subject to any disclaimer, the term of this patent is extended or adjusted under 35 U.S.C. 154(b) by 112 days.

(21) Appl. No.: 13/581,106

(22) PCT Filed: Feb. 28, 2011

(86) PCT No.: PCT/EP2011/000957

§ 371 (c)(1),
(2), (4) Date: Aug. 24, 2012

(87) PCT Pub. No.: WO2011/107242

PCT Pub. Date: Sep. 9, 2011

(65) Prior Publication Data

US 2012/0320345 A1 Dec. 20, 2012

(30) Foreign Application Priority Data

Mar. 1, 2010 (EP) ..... 10002056

(51) Int. Cl.
*G03B 21/14* (2006.01)
*A47L 15/42* (2006.01)
*D06F 39/00* (2006.01)

(52) U.S. Cl.
CPC ..... *A47L 15/4293* (2013.01); *D06F 39/005* (2013.01)
USPC ..... 353/119; 353/30; 353/70; 353/79; 353/122; 345/22; 345/32

(58) Field of Classification Search
USPC ..... 353/28, 30, 69, 70, 79, 97, 98, 119, 353/122; 345/22, 32, 175, 419; 715/788, 715/803, 974; 361/679.01, 724; 348/743–747, E5.137, E9.027
See application file for complete search history.

(56) References Cited

U.S. PATENT DOCUMENTS 3,506,836 A 4/1970 Rueger
5,464,955 A 11/1995 Cole (Continued)

FOREIGN PATENT DOCUMENTS

DE 39 13 636 A1 10/1990
DE 100 17 073 A1 10/2001

(Continued)

OTHER PUBLICATIONS

International Search Report for Application No. PCT/EP2011/000957 dated Aug. 8, 2011.

(Continued)

*Primary Examiner* — Sultan Chowdhury
(74) *Attorney, Agent, or Firm* — Alston & Bird LLP

(57) ABSTRACT

Projector (1) adapted to be installed on a household appliance (26), for projecting visible information onto a projection surface (17) lying outside of said household appliance, the projector comprising a focusing unit (4) that is adapted for focusing a light beam that emanates from a light source (5) onto said projection surface, wherein the focusing unit further comprises at least one fixation element (12) that is adapted to arrange the focusing unit in at least two different focusing positions (13, 13') within said projector (1).

29 Claims, 7 Drawing Sheets

(56) References Cited

U.S. PATENT DOCUMENTS

| | | | | |
|---|---|---|---|---|
| 5,983,190 | A | 11/1999 | Trower, II et al. | |
| 6,031,519 | A | 2/2000 | O'Brien | |
| 6,334,684 | B1 | 1/2002 | Yoshida et al. | |
| 6,377,238 | B1 | 4/2002 | McPheters | |
| 6,396,409 | B1 | 5/2002 | Yeh | |
| 6,513,160 | B2 | 1/2003 | Dureau | |
| 6,614,422 | B1 | 9/2003 | Rafii et al. | |
| 6,650,318 | B1 | 11/2003 | Arnon | |
| 6,817,726 | B2 | 11/2004 | Nowak | |
| 6,943,762 | B2 | 9/2005 | Leja | |
| 7,004,588 | B2 * | 2/2006 | Sadler | 353/28 |
| 7,054,045 | B2 | 5/2006 | McPheters et al. | |
| 7,227,532 | B2 | 6/2007 | Bohn et al. | |
| 7,242,388 | B2 | 7/2007 | Lieberman et al. | |
| 7,308,186 | B2 | 12/2007 | Kaczmarek | |
| 7,385,359 | B2 | 6/2008 | Dowling et al. | |
| 7,426,467 | B2 | 9/2008 | Nashida et al. | |
| 7,539,513 | B2 | 5/2009 | Cathey, Jr. et al. | |
| 7,658,806 | B2 | 2/2010 | Jeong et al. | |
| 7,766,525 | B2 | 8/2010 | Rosenbauer et al. | |
| 7,798,655 | B2 * | 9/2010 | Matsuura et al. | 353/99 |
| 7,824,039 | B2 * | 11/2010 | Takito et al. | 353/69 |
| 7,845,809 | B2 | 12/2010 | Busing et al. | |
| 7,881,901 | B2 | 2/2011 | Fein et al. | |
| 8,003,923 | B2 | 8/2011 | Wilsdorf | |
| 8,081,085 | B2 | 12/2011 | Jerg et al. | |
| 8,154,857 | B2 * | 4/2012 | Kendall et al. | 361/679.01 |
| 2001/0043313 | A1 * | 11/2001 | Okura | 353/97 |
| 2002/0070921 | A1 | 6/2002 | Feldman | |
| 2002/0152045 | A1 | 10/2002 | Dowling et al. | |
| 2003/0209018 | A1 | 11/2003 | Becke et al. | |
| 2004/0125929 | A1 | 7/2004 | Pope | |
| 2004/0135780 | A1 * | 7/2004 | Nims | 345/419 |
| 2005/0060746 | A1 | 3/2005 | Kim | |
| 2005/0117130 | A1 | 6/2005 | Bohn et al. | |
| 2006/0123680 | A1 | 6/2006 | Hering et al. | |
| 2006/0232997 | A1 | 10/2006 | Rosenbauer et al. | |
| 2007/0069979 | A1 | 3/2007 | Rosenbauer et al. | |
| 2008/0106429 | A1 | 5/2008 | Kaczmarek et al. | |
| 2008/0117485 | A1 | 5/2008 | Cyprus | |
| 2008/0163906 | A1 | 7/2008 | Lee | |
| 2008/0178916 | A1 | 7/2008 | Kedjierski | |
| 2008/0236563 | A1 | 10/2008 | Wilsdorf | |
| 2008/0276976 | A1 | 11/2008 | Buller et al. | |
| 2009/0109176 | A1 | 4/2009 | Fein et al. | |
| 2009/0113348 | A1 | 4/2009 | Fein et al. | |
| 2009/0119604 | A1 | 5/2009 | Simard et al. | |
| 2009/0262098 | A1 * | 10/2009 | Yamada | 345/175 |
| 2010/0126493 | A1 | 5/2010 | Gokceimam et al. | |
| 2010/0147338 | A1 | 6/2010 | Busing et al. | |
| 2012/0002292 | A1 | 1/2012 | Iwasawa et al. | |
| 2012/0320345 | A1 | 12/2012 | Kleinert et al. | |
| 2013/0134846 | A1 | 5/2013 | Busing et al. | |

FOREIGN PATENT DOCUMENTS

| | | | |
|---|---|---|---|
| DE | 102 59 763 | A1 | 7/2004 |
| DE | 10 2005 011 295 | A1 | 9/2006 |
| DE | 102005011295 | A1 | 9/2006 |
| DE | 102010003103 | A1 | 9/2011 |
| DE | 102011002939 | A1 | 7/2012 |
| DE | 102011076374 | A1 | 11/2012 |
| DE | 102011081334 | A1 | 11/2012 |
| EP | 1 207 353 | A2 | 5/2002 |
| EP | 1 421 893 | | 5/2004 |
| EP | 1 421 893 | A1 | 5/2004 |
| EP | 1 489 364 | A1 | 12/2004 |
| EP | 1 489 364 | B1 | 12/2004 |
| EP | 1 512 914 | A2 | 3/2005 |
| EP | 1 814 003 | | 8/2007 |
| EP | 1 814 003 | A1 | 8/2007 |
| EP | 1 859 720 | A1 | 11/2007 |
| EP | 1 576 632 | B1 | 12/2008 |
| JP | 52-057633 | A | 5/1977 |
| JP | 62-134338 | A | 6/1987 |
| JP | 2003-272815 | A | 9/2003 |
| JP | 2007-301128 | A1 | 11/2007 |
| WO | WO 98/31864 | A1 | 7/1998 |
| WO | WO 2004/052168 | A1 | 6/2004 |
| WO | WO 2004/057636 | A1 | 7/2004 |
| WO | WO 2005/041743 | A1 | 5/2005 |
| WO | WO 2006/013009 | A1 | 2/2006 |
| WO | WO 2006/069831 | A1 | 7/2006 |
| WO | WO 2006/128696 | A1 | 12/2006 |
| WO | WO 2007/039621 | A1 | 4/2007 |
| WO | WO 2008/046884 | A1 | 4/2008 |
| WO | WO 2009/121380 | A1 | 10/2009 |

OTHER PUBLICATIONS

European Search Report for Application No. EP 10 00 2056; dated Jul. 6, 2010.

International Preliminary Report on Patentability and Written Opinion for Application No. PCT/EP2011/000957; dated Sep. 4, 2012.

* cited by examiner

PROJECTOR AND HOUSEHOLD APPLIANCE COMPRISING SUCH A PROJECTOR

CROSS REFERENCE TO RELATED APPLICATIONS

This application is a national stage application filed under 35 U.S.C. 371 of International Application No. PCT/EP2011/000957, filed Feb. 28, 2011, which claims priority from European Patent Application No. 10002056.9, filed Mar. 1, 2010, each of which is incorporated herein in its entirety.

The invention in particular is directed to a projector adapted to be installed on a domestic or household appliance, such as a dishwashing machine, for example.

The projector is designed for projecting operating information concerning the household appliance on a projection field, such as the on/off-state of the appliance, etc.

Such a projector is known for example from EP 1 421 893 B1. With such a projector, it is important to provide adequate perceptibility of the projected visible information to a person operating the household appliance. Further, it is desirable that the projected visible information has adequate sharpness and brightness. The projector of the prior art does allow an adaption of sharpness or brightness that however may be necessary as mounting locations of the appliance, mounting positions of the projector, locations and orientations of respective projection surfaces may vary from case to case.

A household appliance of the above-mentioned type is also disclosed, for example in DE 102 59 763 A1 and WO 2006/013009 A1. The projection devices of such appliances are to improve the visibility of an operation display by projecting the light emitted from the light source on a projection field, in particular on a working surface of the appliance or on a floor area in front of the appliance. In order to allow a projection of light on the floor area, the light source is normally arranged at a lower portion of the appliance such as at a lower part of the door or at the baseboard. However, at these locations there is normally only small installation space available, what makes the assembly of the light source very difficult.

In order to project light on the working surface of the appliance it is necessary to arrange the light source on the working surface itself or above the working surface, in particular at a bottom side of a kitchen cupboard or at a wall portion extending above the appliance. Depending on the height, on which the light source is to be arranged, the length of the electric cable, which connects the light source with the controller of the projection device, needs to be adjusted. However, such an adjustment can only be done by a person who is practised with the handling of electric components, such as an electrician. Accordingly, such an adjustment cannot be carried out by everyone.

Based on these considerations it is an object of the invention to provide a projector adapted to be installed on a household appliance, providing excellent projection perceptibility, in particular sharpness and brightness, for a variety of different household appliances and conditions and positions the appliance is supposed to operate. Similarly, a household appliance comprising such a projector shall be provided.

A further object of the invention is to provide a household appliance of the above-mentioned type, which enables an easy assembly of the projection device, in particular at locations, where only small installation space is available, and an easy modification of the location, from where the light emitted from the light source is projected on the projection field, without the need for basic knowledge concerning the handling of electric components.

This object is achieved by the features listed in claims 1 and 15. Embodiments of the invention result from dependent claims 2 to 14.

A first aspect of the invention is directed to a projector adapted to be installed on a household appliance which may be a dishwasher, a washing machine and the like.

The projector is for projecting visible information onto a projection surface.

The visible information to be projected may be information about the operational state of the appliance, preferably on/off state information, program cycle state information such as cycle stage information, remaining run time information or start time pre-selection information, night cycle or silence mode information, or information on how to operate the appliance, in particular information guiding the user in operating and in setting operational parameters of the appliance, or any other information.

Preferably, the projection surface is a surface lying outside of said household appliance, preferably lying close, nearby or adjacent to the projector or appliance, respectively. However, as the case may be also surfaces remote from the projector and appliance, respectively, may be considered. The surface may be a part of a floor, wall or ceiling of a building or room in which the appliance is installed. Preferably, the surface is a floor on which the household appliance is positioned. Other surfaces such as outer faces of furniture, of nearby appliances and the like may serve as projection surface as well.

Advantageously the projection surface is selected to lie within the ordinary field of view of a user looking towards or operating the appliance. In this way, the user can see the displayed visible information just in a single glance, preferably even if the user is at a distance from the appliance.

The projector preferably comprises an outer casing. The projector comprises a focusing unit that can be preferably accommodated within said outer casing. The focusing unit may comprise projection elements such as a light source, preferably a LED-based light source, a first optical lens unit and an information display mask such as digital information display mask, in particular a LCD information display mask. The light source that is comprised within the focusing unit is preferably itself a lamp such as e.g. an LED or the like, however the light source that is comprised within the focusing unit can also be the end of a light guide that receives light at its opposite end from a remotely installed lamp such as LED or the like.

The projector further comprises at least one fixation element adapted to arrange the focusing unit within the projector in at least two different focusing positions with respect to the direction of projection of the projector, in particular with respect to the direction of the light beam emanating from the light source within the focusing unit. Preferably, said different focusing positions are provided within said outer casing of the projector.

By providing several focusing positions it is possible to flexibly adapt the focusing parameters of the projector according to respective mounting conditions. Here the mounting conditions in particular refer to the installation of the projector on the appliance and the distance between the projector and the projection surface. As will be seen, the optical quality of the visible information projected onto the projection surface, i. e. the projection image, can readily be improved by suitably adapting the position of the focusing unit within the projector. As already mentioned, such a change may be required as the location and orientation of respective projection surfaces relative to the projector and the appliance varies from case to case.

For example, the projector may be installed on a sidewall of the household appliance, in, on or below an upper or a lower section of a front panel of the appliance, behind and/or below a front door, and/or behind and/or below a decorative front door panel of the appliance, each installation position requiring different modes of projection with respect to optimal perceptibility, sharpness and brightness. The mode of projection can inter alia be changed by changing the focusing position.

In a particular important embodiment, the appliance and/or the projector may be mounted at different levels relative to the ground or floor level. Here, different modes of projection may be required in order to ensure high quality projections for different mounting levels. Again, sufficient projection perceptibility can inter alia be obtained by selecting an adequate focusing position of the focusing unit.

With regard to constructional aspects, a comparatively simple implementation can be obtained if the focusing positions lie discrete. The focusing positions may be represented by discrete arrangement positions mutually spaced at predefined intervals in a direction parallel to the direction of projection. As an example, a latch system may be provided to latch the focusing unit at discrete arrangement positions. The latch system may comprise a pin and corresponding pin-holes.

In a more elaborate embodiment, the discrete focusing positions may be merged to a continuum or quasi continuum of different focusing positions. Here, quality of projection, in particular perceptibility and sharpness, can be fine-tuned.

In the aforementioned more elaborate embodiment, it may facilitate the setting of a projection position if the fixation elements comprise a guidance device. Such a guidance device may be adapted to arbitrarily select a focusing position from the quasi-continuum or continuum of possible focusing positions. The guidance device may comprise a guide-rail system or wheel-rail system for moving the focusing unit to arbitrary positions with respect to the direction of projection. A guidance device is one of the possibilities to moveably arrange the focusing unit within the outer housing.

As already indicated above, the focusing unit may comprise one or more projection elements. The projection elements may be at least one of at least one light source, such as a light-emitting diode (LED) or the end of a light guide as mentioned already above, a first optical lens unit that comprises at least one optical lens, in particular a focusing lens, and at least one information display mask that, preferably a digital information display mask, such as a liquid crystal digital information display mask. An information display mask shall be understood herein in general to comprise any information display device that can be arranged within the focusing unit to be traversed by the light beam emanating from said light source and that is at least partially transparent to said light beam, wherein said transparency can be changed in order to provide different visible information to said light beam that can subsequently be projected by said projector onto said projection surface. By using such information display mask, it is possible to adequately project a great variety of different visible information, such as information relating to current operational states of the appliance, in particular at quasi real-time conditions.

The projection element(s) are preferably accommodated in an inner casing of the focusing unit. The casing allows to attach all the projection elements on a common basis and to move them in concert. Further, the inner casing can be adapted to protect the projection elements from environmental impacts such as humidity, diffuse light and the like.

The projector or the focusing unit may comprise an interface adapted to communicate with electronic components, such as controls, of the appliance. Via the interface, general or user specific information with regard to operating or handling the appliance may be provided. If required, this information can be processed for extracting or generating visible projection information to be visualized in a projection image.

The focusing unit may comprise a control unit, such as a printed circuit board, to which at least one of the projection elements is connected to for being controlled by it. As an example, the light source and digital information display mask can be connected to the printed circuit board, preferably via flexible wires. The control unit may comprise electronic components such as control elements required for controlling respective projection elements. The control unit may also comprise a processing unit for processing incoming information for generating or extracting information required for generating the projection image.

The control unit may be attached to the inner casing of the projector, allowing the control unit to be moved in concert with the focusing unit and projections elements. In the alternative, the control unit may be attached to an outer surface of the inner casing or to an inner or outer surface of the outer casing.

However, it is also possible that the control unit is mounted independently or distant from the inner or outer casing. Here, the control unit may be connected to respective projection elements via flexible wires, wireless connections or the like.

In order to further improve the projection perceptibility, sharpness and brightness, the projector can comprise additional projection elements positioned downstream of the focusing unit. Such an additional projection element can be a mirror, in particular a tilted mirror, a second optical lens unit that can comprise at least one focusing lens, at least one prism and/or any other optical element that can support focusing the visible information onto the projection surface. Additional projection elements, if required, can be used and adapted to adequately deflect and focus the visible information towards the respective projection surface. In this way, excellent perceptibility, sharpness and brightness, can be obtained.

In order to facilitate verification of the position of the focusing unit, the projector may comprise an indication element adapted to indicate the respective focusing position at the outside of the outer casing.

A comparatively effective and simple implementation of an indication element is a pin attached to the focusing unit or the inner casing and passing through a respective opening or pin-hole of the outer casing.

A preferred further development of the invention proposes that the projector comprises at least one flexible light conducting cable connected to the at least one light source such that the light emitted from the light source is guided to a free cable end of the light conducting cable, from where it is projected on the projection field.

In this case an easy optical height correction can be obtained to ensure a sharp display of information on the floor by avoiding a cost expensive optical correction. A preferred respective design proposes that the free cable end is arranged in a housing, wherein the housing is arranged adjustable in a longitudinal direction in a carrier element. Advantageously, a lens is arranged in the housing before the free cable end, wherein preferably the carrier element has a slot extending in the longitudinal direction. This allows an easy height adaption of the housing with the free cable end.

This function is beneficial because a dishwasher or another home appliance will be installed in the kitchen cabinet according to kitchen furniture dimension, which can be more than 10 cm.

There are some further beneficial features for the design of the home appliance:

A controller and/or the at least one light source can be integrated in a main control unit. The projection device and the main control unit can be integrated in an appliance door.

The free cable end can be positioned at a bottom side of the door of the appliance, in particular at a door hinge, such that the light is projected on a floor area in front of the appliance, said floor area serving as the projection field.

The projecting device can comprises several flexible light conducting cables, whose free cable ends are positioned at different locations.

An optical connecting device can be fixed or can be fixable to the free cable end of the at least one light conducting cable for connecting a flexible light conducting extension cable and/or an optical lens system. Here, an optical connecting device can be fixed or can be fixable to the free cable end of the flexible light conducting extension cable for connecting an optical lens system.

As can be seen, the first aspect of the invention provides a projector enabling excellent projection perceptibility for a great variety of different conditions and positions the appliance is supposed to operate.

A second aspect of the invention is directed to a household appliance comprising a projector according to the first aspect of the invention. As to advantages and advantageous effects of the household appliance of the second aspect, reference is made to the first aspect of the invention.

Without prejudice, the household appliance may be a dishwasher, a washing machine, a baking oven or any other appliance for household purposes.

Many of the household appliances mentioned beforehand make it possible to arrange the projector on a side wall or behind and/or below a front door, and/or behind and/or below a decorative front panel of the household appliance. The front side of the appliance may be a preferred mounting position for the projector if the projection surface is located in front of the appliance. For example, this is the case with the projection surface being a floor section in front of the appliance. Other mounting locations may be considered depending on respective m projection requirements. For example, optimal mounting positions suitable for projecting visible information to a ceiling will differ from those suitable for projecting visible information to a floor or vertical wall section.

As can be seen, also the second aspect of the invention provides for excellent projection perceptibility for a variety of different conditions prevailing with different household appliances.

The present invention allows according to a preferred embodiment that not only the controller but also the light source of the projection device can be arranged at almost arbitrary locations of the household appliance, where enough installation space is available. The flexible light conducting cable is then guided from the light source to the location, from where the light is to be projected on the projection field. Since the light conducting cable only needs marginal installation space, it can thereby also be guided to locations that offer very little installation space. Therefore, the construction and the assembly of the projection device are very comfortable and easy. Since a flexible light conducting cable is no electric component, there is no electrical hazard for the user when handling it. Accordingly, a user can manipulate the flexible light conducting cable without danger, e.g. when shortening the cable.

In order to safe installation space the controller and/or the at least one light source can be integrated in the main control unit. However, it is also possible to provide the controller, the main control unit and the at least one light source as separate units and to connect them with respective conductors.

The at least one light source is preferably a LED, such as a single coloured LED or a multi-colour LED for signalising different operating information concerning the household appliance by means of projecting different colours on the projection field. If several light sources are used, such as a plurality of LEDs, each of these light sources can be connected to a separate flexible light conducting cable. Alternatively, several LEDs can be connected to one single flexible light conducting cable by means of an appropriate optical connecting member, which may have a fork-like shape.

If the projection field is a floor area in front of the household appliance, the projection device and the main control unit are preferably integrated in the door of the appliance. The free cable end may be positioned at a bottom side of the door or may be guided through a door hinge, such that the free cable end points to the respective floor area.

In order to allow a user to modify the location, from where the light emitted from the light source is projected on the projection field, an optical connecting device can be fixed to the free cable end of the at least one light conducting cable for connecting a flexible light conducting extension cable. Alternatively, an optical lens system may be connected to the optical connecting device in order to impair the modality, in which the light is projected on the projection field. If a flexible light conducting extension cable is used, an optical connecting device may also be fixed to the free cable end of the extension cable in order to connect an optical lens system.

According to a further aspect of the present invention, the projecting device comprises several flexible light conducting cables, whose free cable ends are positioned at different locations. Accordingly, the operating information of the appliance can be projected on several projecting fields. Alternatively, the user can choose one preferred projection field from a plurality of different possible projection fields.

Embodiments of the invention will be described in connection with the annexed figures, in which FIG. 1 shows a sectional view of a first embodiment of a projector;

Figure 7:
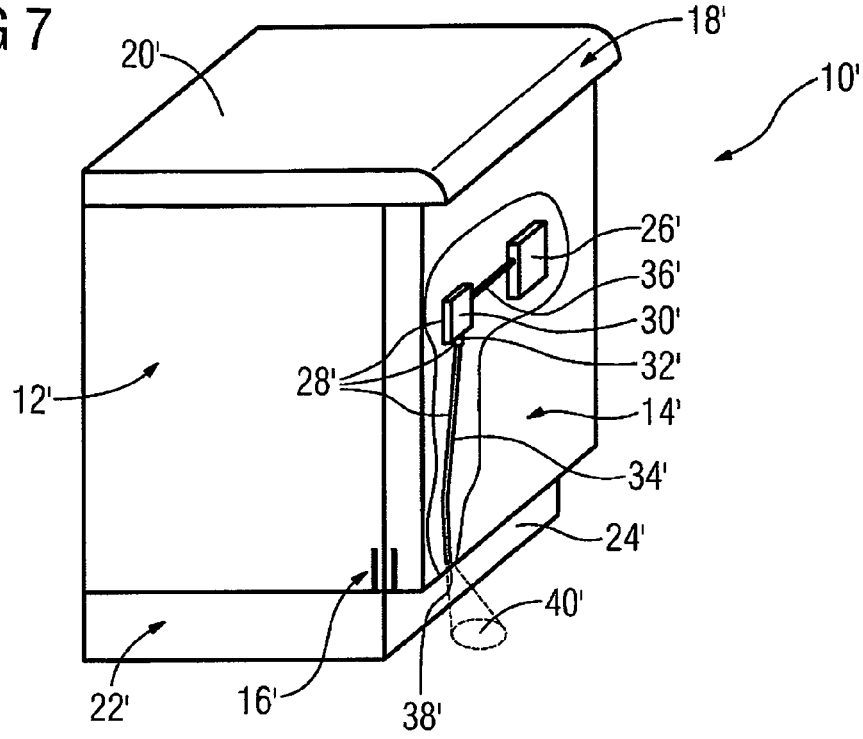
Figure 8:
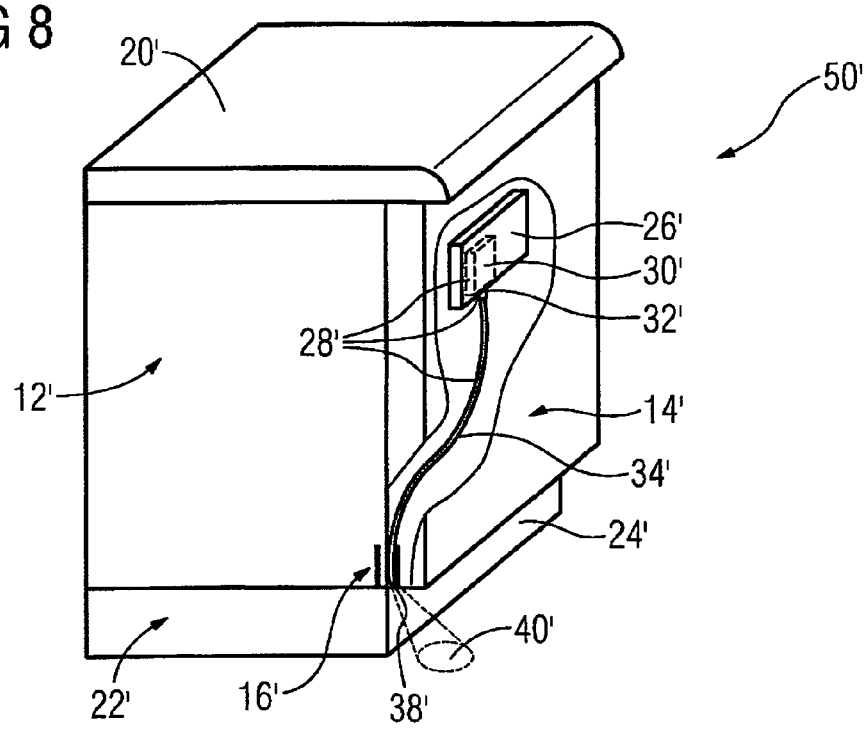
Figure 9:
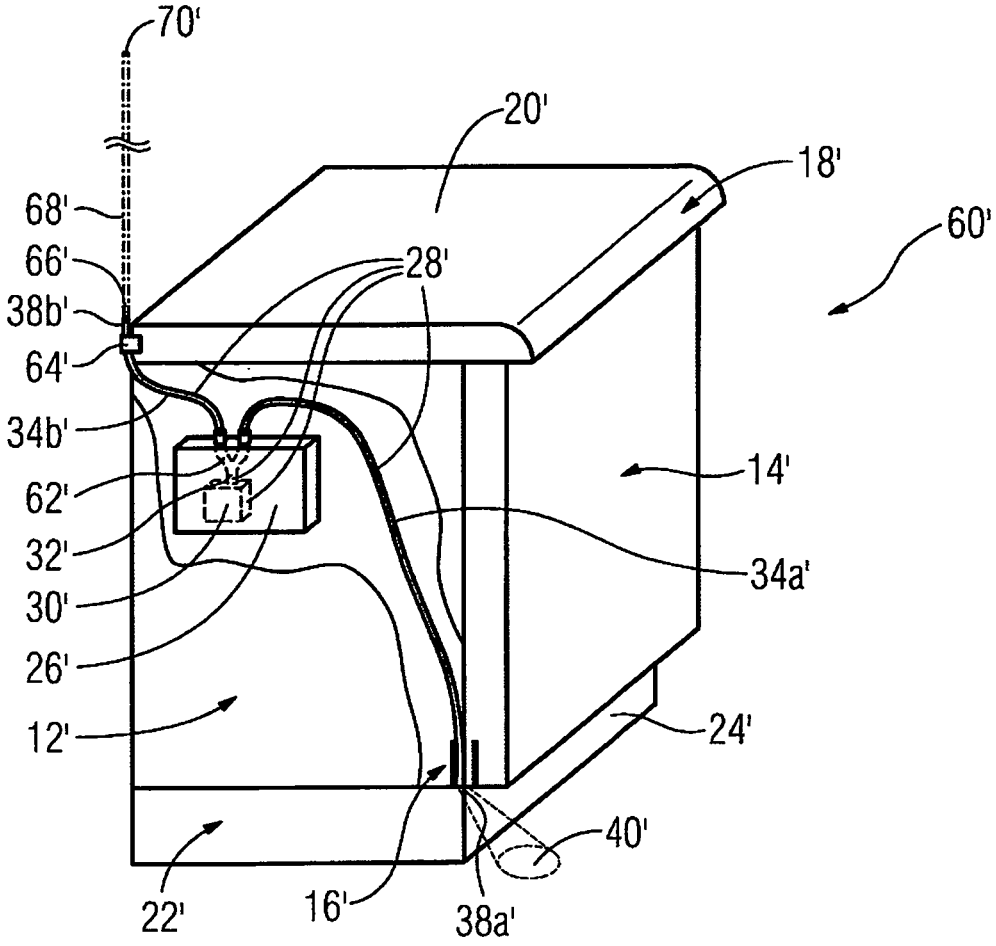
Figure 10:
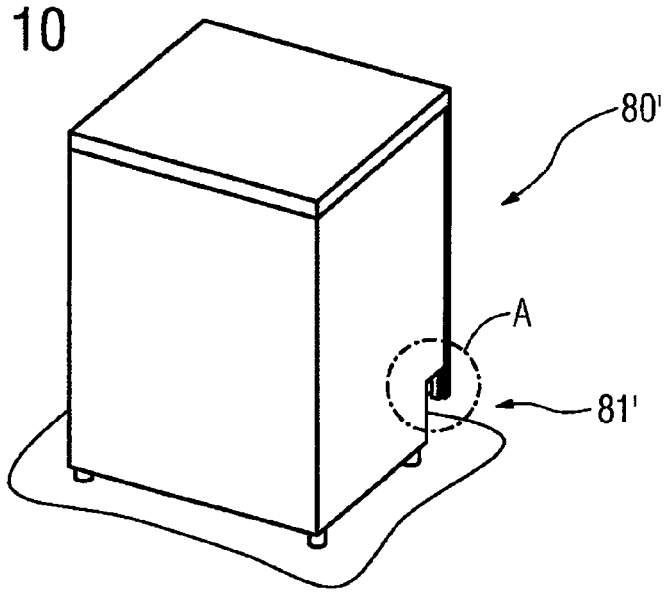
Figure 11:
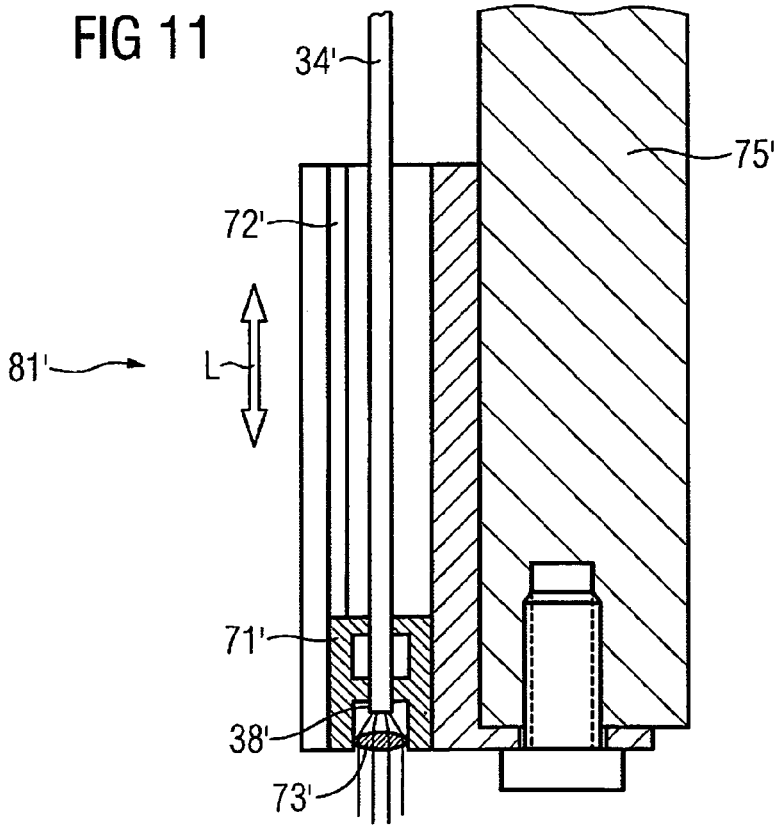
Figure 12:
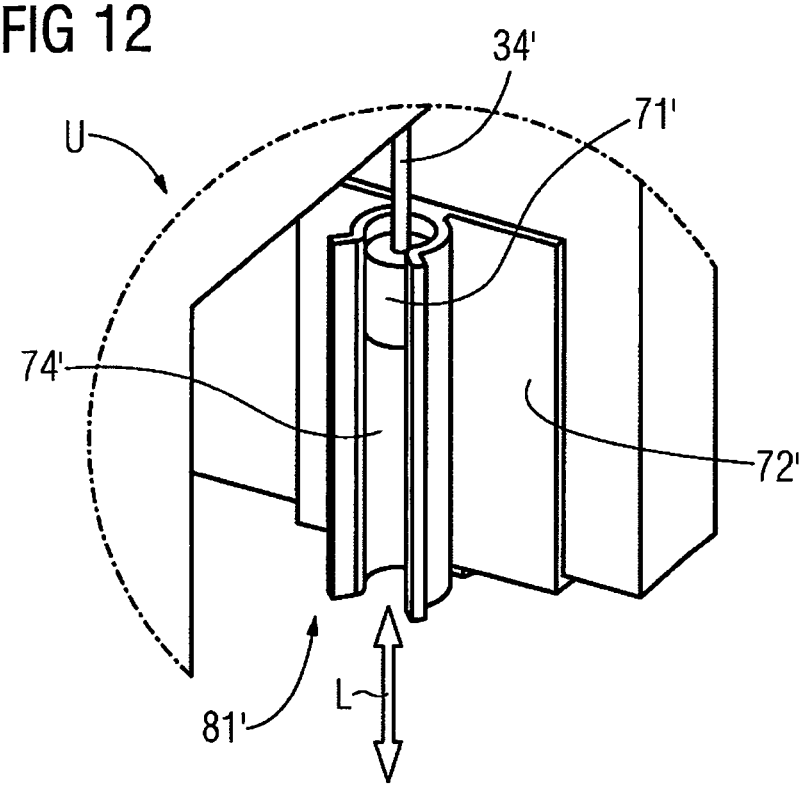
Figure 13:
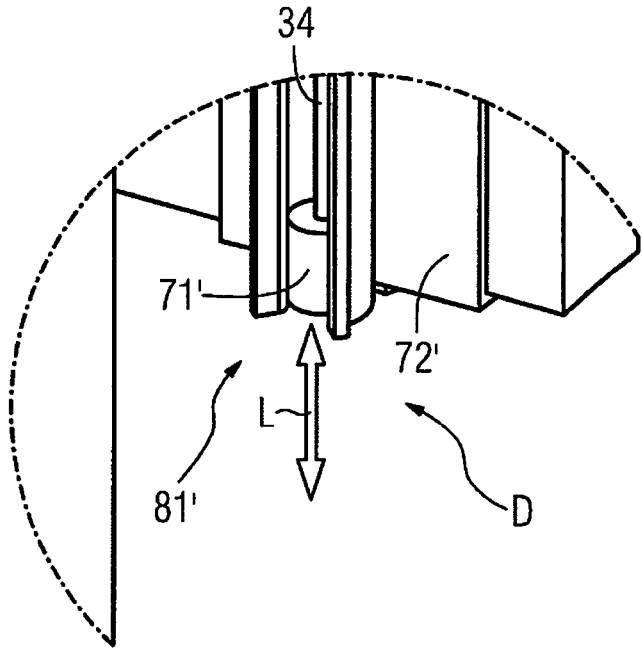

FIG. 7 shows a partially broken perspective view of a household appliance according to a further embodiment of the present invention, FIG. 8 shows a partially broken perspective view of a household appliance according to a still further embodiment of the present invention, FIG. 9 shows a partially broken perspective view of a household appliance according to a still further embodiment of the present invention, FIG. 10 shows a perspective view of a domestic appliance, FIG. 11 shows a cross section of the region "A" according to FIG. 10, where a projector is arranged, FIG. 12 shows a perspective view of the projector according to FIG. 11, wherein a housing of the projector is arranged in an upper position, and FIG. 13 shows a depiction corresponding to FIG. 12, wherein the housing of the projector is arranged in a lower position.

Note that the figures may not be true to scale and scales may vary. It shall further be noted that for sake of simplicity, the embodiments shown and described in connection with the figures may comprise claim features not necessarily required by the invention. As the case may be, some of the features can be omitted or applied as explained in the specification above. Also, alternative and optional features as set out above or below may be used both alone and in concert with those shown in the figures. In the figures, like elements have like functions and are indicated with like reference signs, if not otherwise stated.

Figure 1:
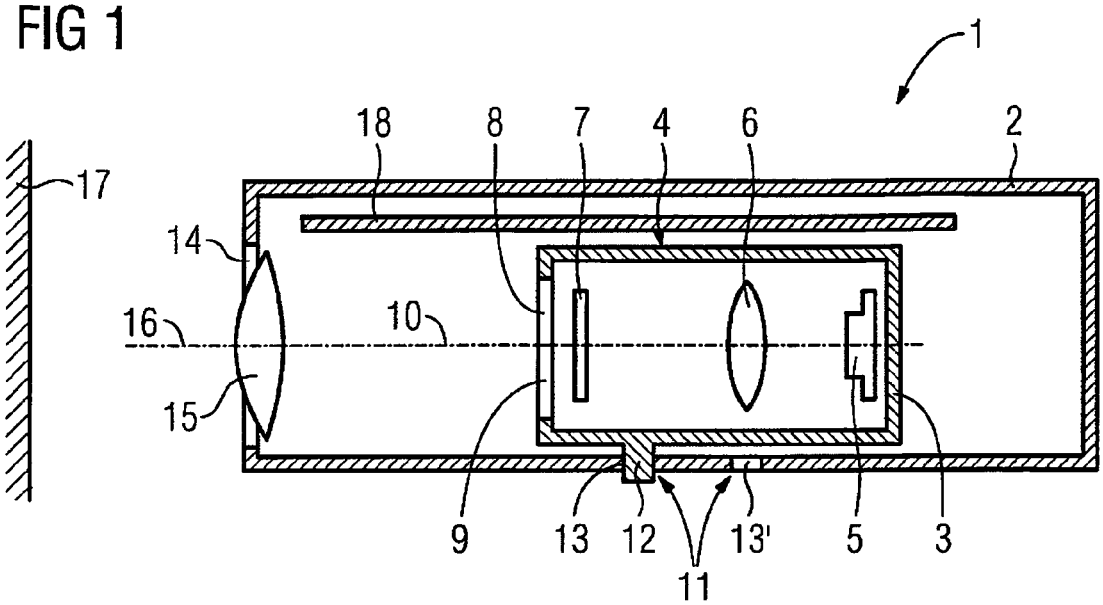

FIG. 1 shows a sectional view of a first embodiment of a projector 1. The projector 1 comprises an outer casing 2. Further, the projector 1 comprises an inner casing 3 accommodated within the outer casing 2.

The inner casing 3 is part of a focusing unit 4 comprising several projection elements arranged within the inner casing 3. With the present embodiment the projection elements are represented by a light source 5, such as an LED light source, a first optical lens unit 6 for focusing light emitted by the light source 5 on a information display mask 7 which is an LCD digital information display mask in the present case.

The inner casing 3 comprises an inner projection window 8. The inner projection window 8 is located at the inner casing face side oriented away from the light source 5. The inner projection window 8 may comprise a transparent panel 9 allowing light having passed through the information display mask 7 to escape from the inner casing 3 in a direction parallel to a primary light beam 10 emanating from the light source 5 as defined by the mutual arrangement of the projection elements mentioned so far.

The transparent panel 9 may be designed to tightly close the inner projection window 8 which represents an opening in the inner casing 3. In this way, the transparent panel 9 serves inter alia for shielding the projection elements accommodated in the inner casing 3 from dust, moisture and the like.

At least one light filter may be provided with the inner projection window 8 or transparent panel 9, in order to adapt the color shade of the light having passed the information display mask 7 to respective needs. The light filter may be a coating provided on the transparent panel 9. However, the transparent panel 9 itself may constitute a light filter.

The projector 1 further comprises fixation elements 11 for arranging the focusing unit 4 at respective focusing positions 13, 13' within the outer casing 2. The fixation elements 11 of the present embodiment are represented by a pin 12 and two pin-holes 13, 13'.

The pin 12 projects from an outer surface of the inner casing 3. The pin-holes 13, 13' are provided in the outer casing 2. The pin 12 and pin-holes 13, 13' are arranged such that the pin 12 can engage either one of the pin-holes 13, 13'. In more detail, the fixation elements 11 are arranged in such a way that the focusing unit 4 can be arranged in two different focusing positions 13, 13' with respect to the primary light beam 10. Note that the primary light beam 10 represents the direction of projection of the focusing unit 4. With the configuration shown in FIG. 1, the pin 12 engages the left-hand side pin-hole 13. With the configuration shown in FIG. 2, the pin 12 engages the right-hand side pin-hole 13'. Note that more than just two pin-holes 13, 13' and therefore more than two focusing positions 13, 13' may be provided.

The outer casing 2 comprises an outer projection window 14 arranged downstream the inner projection window 8 in a direction parallel to the primary light beam 10. A second optical lens unit 15 is positioned in the outer projection window 14. Note that the second optical lens unit 15 is not mandatory but may be helpful in improving perceptibility, sharpness and brightness of a projection image projected onto the projection surface 17. The second optical lens unit 15 can be used to further focus the light emitted by the focusing unit 4, for example.

In the present case, the primary light beam 10 coincides with the optical axis of the second optical lens unit 15. The optical axis of the second optical lens unit 15 corresponds to the optical axis of the secondary light beam 16. Note that the secondary light beam 16 can be different from that of the primary light beam 10, which is the case with embodiments presented further below.

Light having passed the second optical lens unit 15 finally impinges on a projection surface 17 generating a projection image containing the visible projection information.

Electronic elements for operating and controlling the projection elements, in the present case the light source 5 and information display mask 7, may be provided with a control unit 18 arranged within the outer casing 2, preferably fixed to an outer or inner surface of the inner casing 3. The control unit 18 may comprise a printed circuit board communicating with active projection elements, i. e. the light source 5 and the information display mask 7 in the present case, via cable bound or wireless communication. A flexible wire connection may be used to connect the control unit 18 to the active projection elements. Further, a flexible wire connection may also be used to connect the control unit 18 one or more interfaces (not shown) for at least one of data exchange and power supply, for example. The interfaces may be arranged on or at an outer surface or recess (see FIG. 4) of the outer casing 2.

Both wireless and flexible wire connections account for the fact that the focusing unit 4 can be positioned in different positions within the outer casing 2.

If visible information is to be projected onto the projection surface 17, the light source 5 and information display mask 7 are operated such that light emanating from the light source 5 passes through the information display mask 7 thereby projecting the visible information provided by the information display mask 7 onto the projection surface 17.

It is desirable that the projection image visible on the projection surface 17 has adequate perceptibility to a user, adequate sharpness and brightness. These requirements are especially important if the projection image comprises exacting visible information such as digits, icons or text.

If the projection image does not meet or at least not adequately meet the above mentioned requirements for a given position of the projector 1 relative to the projection surface 17, the focusing unit 4 can be displaced. Such a displacement can be accomplished by arranging the focusing unit 7 in a different one of the focusing positions 13, 13' defined by the pin-holes 13, 13' in the present case.

With the present embodiment, the focusing unit 7 can be arranged in two different discrete focusing positions 13, 13'. However, it is also possible to provide a plurality of different positions. This can be accomplished by providing a respective number of pin-holes 13, 13', 13" etc. for example.

A pin 12 engaging and thereby projecting through one of the pin-holes 13, 13' is used with the present embodiment. This has the advantage that the pin 12 indicates the focusing position 13, 13' of the focusing unit 7 to the outside of the outer casing 2. Thus, it is not mandatory to open the outer casing 2 for determining or checking the respective focusing position 13, 13'. Other indication elements can be used as well, for example if latching elements other than the pin 12 and pin-holes 13, 13' are used, and which are per se not visible from the outside.

In another embodiment (not shown) the positions can be selected from a preset continuum of focusing positions 13, 13'. Here, it is possible to arrange the information display mask 7 via a guidance device, such that the information display mask 7 can be moved in parallel to the primary light beam 10 to any position of the continuum. The guidance device may comprise rails and corresponding sliding elements adapted to slidably engage the rails.

Figure 2:
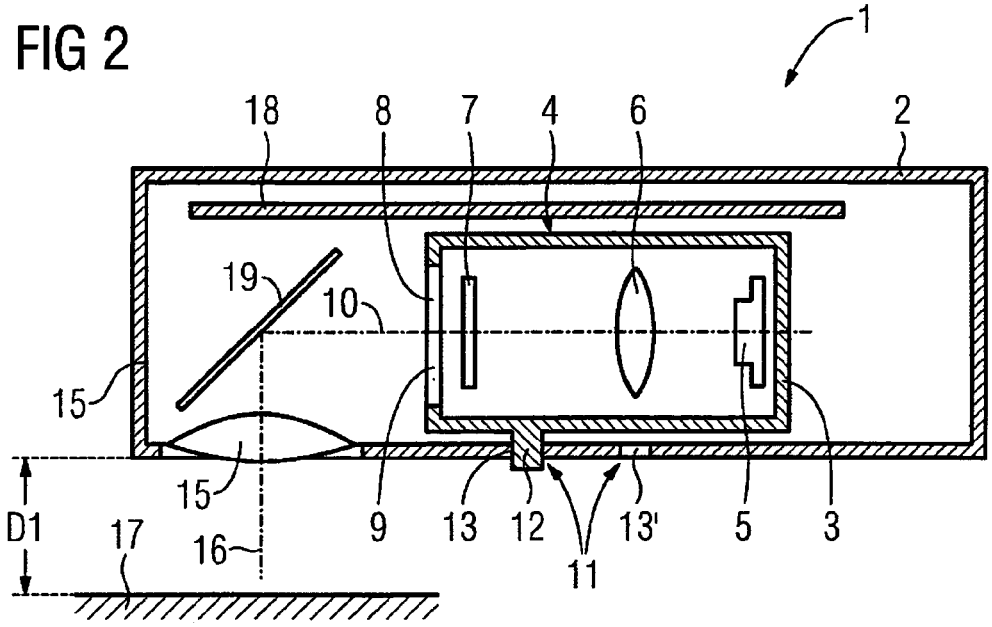
FIG. 2 shows a sectional view of a second embodiment of a projector.

FIG. 2 shows a sectional view of a second embodiment of a projector 1.

The embodiment of FIG. 2 differs from that of FIG. 1 in that a further optical element viz. a tilted mirror 19 is arranged downstream the focusing unit 4. The tilted mirror 19 is tilted by about 45 degrees with respect to the primary light beam 10. Hence, the tilted mirror 19 defines a secondary light beam 16 running approximately perpendicular to the primary light beam 10. In this way, visible information to be projected, i. e. light emitted from the focusing unit 4, hits the tilted mirror 19 and is deflected towards the second optical lens unit 15 arranged in a sidewall of the outer casing 2. The light exits the outer casing 2 via the second optical lens unit 15 and finally hits the projection surface 17 located in a first distance D1 from the outer casing 2.

By using the tilted mirror 19 the projector 1 can be used even with projection surfaces 17 displaced or tilted with respect to the primary light beam 10. Such situations may occur as the mounting position of the projector 1 and relevant geometric conditions generally depend on the type or model of household appliance in question and can not be freely changed or adapted. With the projector 1 shown in FIG. 2 a great variety of different situations, i. e. different mounting positions, different projecting surfaces 17 and the like, can be covered by a single design. Note that the tilted mirror 19 can be tilted by any other angle than 45 degrees, depending inter alia from the distance of the projection surface 17 relative to the projector 1, the position of the second optical lens unit 15 and so on.

The tilted mirror 19 may be pivotably attached within the outer casing 2. In this case, it is possible to at least slightly pivot the tilted mirror 19 to adjust the secondary light beam 16 to the orientation required by the respective projection surface 17. Note that the pivoting movement in general is restricted by the size and the optical properties of the second optical lens unit 15. Alternatively, the outer casing 2 may comprise several fixtures each defining a respective tilt angle.

If the visible information projected onto the projecting surface does not exhibit adequate perceptibility, sharpness or brightness, the focusing unit 4 can be displaced as described in connection with the embodiment shown in FIG. 1 to better comply with respective needs in view of projection quality.

Figure 3:
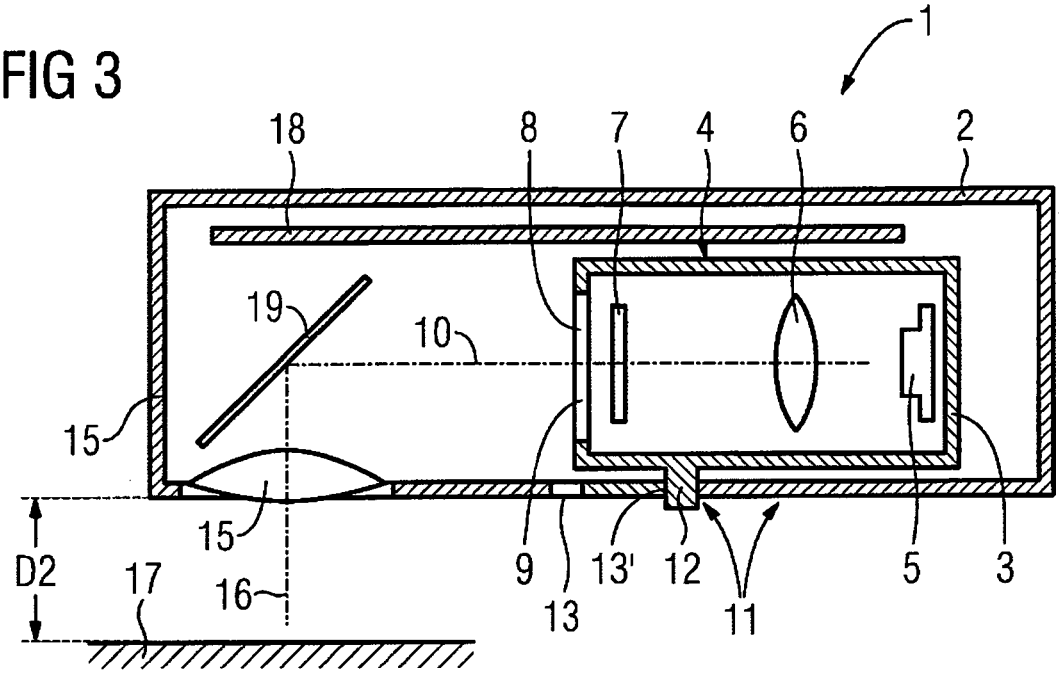
FIG. 3 shows a sectional view of the second embodiment in a different operational state.

Note that in FIG. 2 the focusing unit 4 is arranged in the left side focusing position 13, wherein the corresponding distance between the projector 1 and the projection surface 17 is the distance D1 that is smaller than the distance D2 of the operation state shown in FIG. 3.

FIG. 3 shows a sectional view of the second embodiment in a different operational state. In more detail, the focusing unit 4 is arranged in the right side focusing position 13'. In doing so, the projection quality can be easily altered to exhibit adequate perceptibility, sharpness or brightness to a second distance D2 from the outer casing 2, if required. In the embodiment, D2 is greater than D1.

As can be seen from FIGS. 1 and 2, the focusing position 13, 13' of the focusing unit 4 can be readily identified from the outside of the outer casing 2 via the pin 16 projecting through the respective pin-hole 13 or 13'.

Note that for the sake of clarity not all elements shown in FIG. 2 and FIG. 3 are explicitly identified by reference signs. However, reference is made to corresponding elements shown in FIG. 1. The same applies mutatis mutandis for the figures described below.

Figure 4:
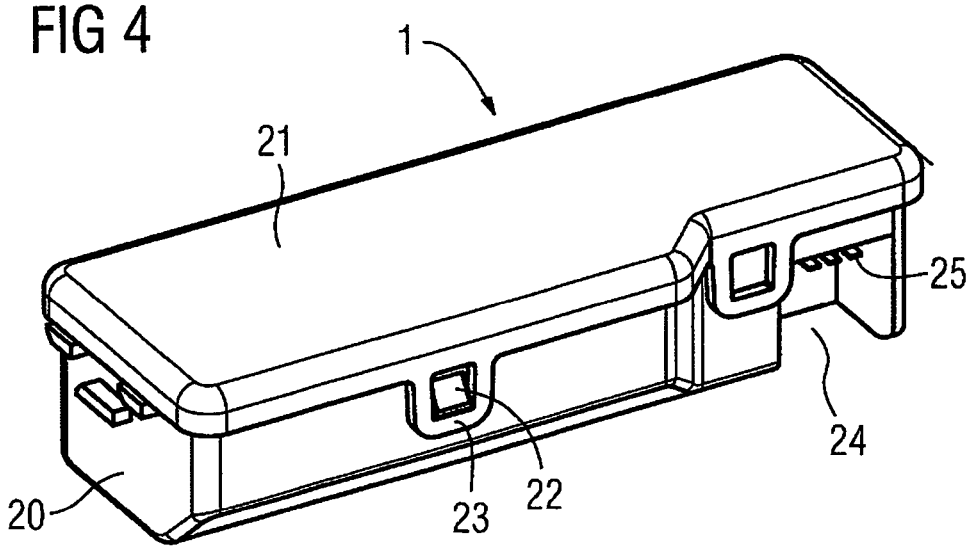
FIG. 4 shows a respective view of a projector.

FIG. 4 shows a perspective view of the outer casing 2 of the projectors 1 shown in FIG. 1 to FIG. 3. As can be seen, the outer casing is of two part design. The outer casing 2 comprises a lower base casing 20 and a cap 21 adapted to cover and tightly close the upper side of the base casing 20. The cap 21 and base casing 20 are fixed to each other via several pairs of corresponding snap elements. Each pair of snap elements in the present case comprise a nose 22 projecting from the base casing 20 and a snap eye 23 provided on an outer rim of the cap 21 and engaging the nose 22 in the closed state of the outer casing 2. Note that the positions of respective snap elements can be arbitrarily interchanged. For example, the noses 22 can be part of the cap 21 and the snap eyes 23 in turn can be part of the base casing 20. It shall be mentioned that any other fastening mechanisms suitable for easily securing the cap 21 to the base casing 20 can be used instead.

With the situation shown in FIG. 4, the optical lens unit 15 is situated at the bottom of the base casing 20, i. e. on the side of the base casing 20 averted from the cap 21.

The outer casing 2 as shown in FIG. 4 comprises a recess 24. The recess 24 accommodates connection elements 25 for establishing electric connections between the projector 1, in particular the control unit 18, and a household appliance (see FIG. 5 and FIG. 6) to which the projector 1 is mounted to. The electric connections may be used for power supply and feeding the projector 1 with information relevant for generating the projection image. Such information may relate to user specific operational details of the appliance, for example. By projecting such details onto the projection surface 17, such as a floor or a wall, the user can easily be informed. Here it is of advantage if the size and position of the projection image on the projection surface is adapted such that it is easily perceptible at a glance even from a distance.

Figure 5:
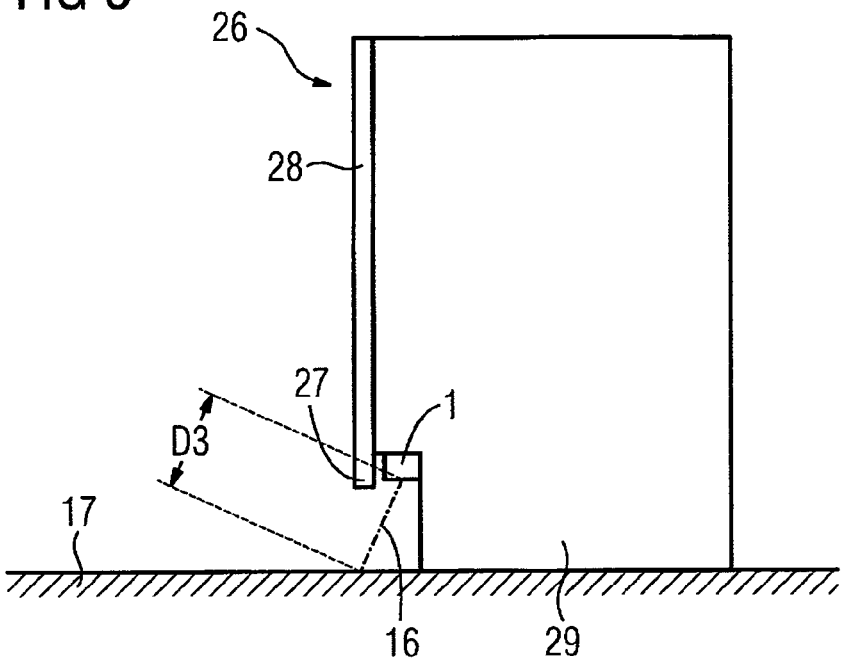
FIG. 5 shows a side view of a household appliance comprising a projector according to FIGS. 2 to 4.

FIG. 5 shows a side view of a household appliance 26 comprising a projector 1 according to FIGS. 2 to 4. Such a household appliance 26 may for example be a dishwasher, as in the present case, or any other household appliance such as a washing machine and the like. The projector 1 is installed on the household appliance 26 behind a lower projecting end 27 of a front door 28. The secondary light beam 16 is indicated by the dash-dotted line. The secondary light beam 16 is tilted vis-à-vis the vertical direction. The projection surface 17 is a section of the floor lying in front of a base stand 29 of the household appliance 26. The secondary light beam 16 is tilted such that the visible information to be projected onto the projection surface 17 is easily visible by a user despite of the fact that the projecting end 27 covers the projector 1 in vertical direction. The tilt of the secondary light beam 16 is set via the tilted mirror 19. Compared to FIGS. 2 and 3, the angle between the light beam 10 and the secondary light beam 16 obviously is different from 45 degrees.

Further, the focusing position 13, 13' of the focusing unit 4 within the outer casing 2 is selected such that the projection image has adequate perceptibility, sharpness and brightness with respect to a third distance D3 between the projector 1 and the projection surface 17.

Figure 6:
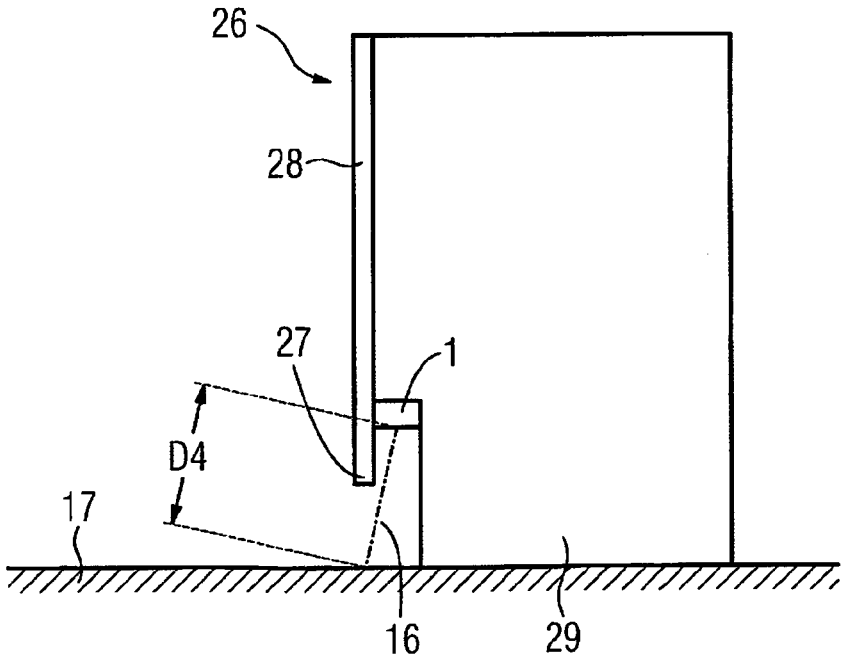
FIG. 6 shows a side view of a further household appliance comprising a projector according to FIGS. 2 to 4.

FIG. 6 shows a side view of a further household appliance 26 also comprising a projector 1 according to FIGS. 2 to 4.

The lower projecting end 27 and the base stand 29 are lengthened compared to those shown in FIG. 5. As a consequence, a forth distance D4 between the projector 1 and the projection surface is greater than the third distance D3. In order to achieve adequate brightness, sharpness and perceptibility of the protection image and to avoid any interference with the lower projecting end 27 the tilt of the secondary light beam 16 and the focusing position 13, 13' of the focusing unit 4 are adapted accordingly. In more detail, the tilt of the secondary light beam 16 to the vertical is reduced as compared to FIG. 5. Further a different focusing position 13, 13' of the focusing unit 4 within the outer casing 2 may be selected in order to meet the requirements as to perceptibility, sharpness and brightness.

As can be seen from the household appliances 26 shown and described in connection with FIGS. 5 and 6, the projector 1 can be easily adapted to a variety of different and respective specific conditions prevailing with different household appliances.

In all, it becomes clear that the object of the invention can be achieved by the projector and household appliance according to the invention.

In FIG. 7, FIG. 8 and FIG. 9 further embodiments of the invention are depicted.

FIG. 7 shows a household appliance according to a further embodiment of the present invention. The household appliance 10', which may be a dishwasher, a washing machine or the like, comprises a housing 12', a door 14', which is attached to the housing 12' by means of door hinges 16', a top plate 18', which is arranged on the housing 12' and defines a working surface 20', and a base frame 22' having a baseboard 24'. A main control unit 26', which is designed for controlling functions of the household appliance 10', is integrated in the door 14'. Moreover, the household appliance 10' comprises a projection device 28', which is composed of a controller 30', a light source 32' and a flexible light conducting cable 34', which are all arranged inside the door 14'. The controller 30' is connected to the main control unit 26' by means of a conductor 36'. The controller 30' receives from the main control unit 26' signals representing operating information concerning the household appliance, which are to be projected by the projection device 28'. Depending on the received operating information the controller 30' controls the light source 32', which is provided in the form of a multi-colour LED. Connected to the light source 32' is the flexible light conducting cable 34', which is guided from the light source 32' to the bottom side of the door 14'. Accordingly the light emitted from the light source 32' is led to the free cable end 38' of the flexible light conducting cable 34' from where it is projected on a floor area 40' in front of the household appliance 10' that serves as the projection field of the projection device 28'. Accordingly, a user can read up on the operating information concerning the household appliance by watching the floor area 40'. For example, a red light can be projected on the floor area 40' in order to represent a running household appliance 10', and a green light can be projected on the floor area 40' for symbolising an off-state of the household appliance 10'. Alternatively, a single colour LED can be used as the light source 32'. In this case, the operating condition of the household appliance 10' can be indicated by a light projected on the floor area 40', whereas no light is projected on the floor area 40' in the off-state of the household appliance 10'. It should be clear that the projection device 28' may also project information in the form of letters, symbols, numbers, etc. However, in this case a light source 32' and/or optical auxiliary means of more complex structure may be required.

FIG. 8 shows a household appliance 50' according to a further embodiment of the present invention. In contrast to the household appliance 10' shown in FIG. 7, the controller 30' and the light source 32' of the projection device 28' are integrated in the main control unit 26' in order to save installation space. Moreover, the free cable end 38' of the flexible light conducting cable 34' is guided through one of the door hinges 16'. Accordingly, no additional fixing means for fixing the free cable end 38' need to be provided.

FIG. 9 shows a further embodiment of a household appliance 60' according to the present invention. The controller 30' and the light source 32' of the projection device 28' are integrated in the main control unit 26' of the household appliance 60'. A fork-shaped optical connecting member 62' is connected to the light source 32' in order to attach two flexible light conducting cables 34*a*' and 34*b*' to the light source 32'. The flexible light conducting cable 34*a*' extends from the main control unit 26' to one of the door hinges 16' and is inserted therein, such that the free cable end 38*a*' of the flexible light conducting cable 34*a*' is directed to the floor area 40'. Accordingly, light conducted through the flexible light conducting cable 34*a*' can be projected on the floor area 40'. The flexible light conducting cable 34*b*' extends from the main control unit 26' to the top plate 18', where it is fixed by fixing means 64' in such a manner that the free cable end 38*b*' of the flexible light conducting cable 34*b*' is directed upwards in an essentially vertical direction. An optical connecting device 66' is fixed to the free cable end 38*b*' of the flexible light conducting cable 34*b*' in order to connect a flexible light conducting extension cable 68' to the free cable end 38*b*'. This flexible light conducting extension cable 68' can be arranged by a user in a desired manner. Thus the free cable end 70' of the flexible light conducting extension cable 68' can be arranged e.g. underneath a kitchen cupboard (not shown), in order to project operation information concerning the household appliance 50' on the working surface 20'.

The household appliance 60' allows the user to choose, whether the projection device 28' is to project operating information on the floor area 40' or on the working surface 20' or on both.

One advantage according to the invention is that the light efficiency in the floor can be constant even with different installation height of the appliance, because optical fiber is a flexible corrector.

FIG. 10 till FIG. 13 show a further development of the present invention.

In FIG. 10 a domestic appliance 80' is shown being for example a dish washer. As explained above the appliance is equipped with a projector 81' which is arranged at a corner of the appliance 80' in a bottom region which is marked with "A".

The projector 81' is shown in a cross section in FIG. 11 and in two working positions U (up) and D (down) in FIG. 12 and FIG. 13. All FIGS. 11, 12 and 13 refer to the detail "A" as shown in FIG. 10.

As explained above light from a light source is fed through a flexible light conducting cable 34' to a free cable end 38' (see FIG. 11). The free cable end 38' is held by a housing 71'. The housing 71' is arranged adjustable in a longitudinal direction L. For doing so, the housing 71' is arranged in a carrier element 72'. The carrier element 72' can be an extruded plastic profile with a cross section as depicted in FIG. 12 and FIG. 13. Thus, the carrier element 72' can have a slot 74'; the housing 71' is elastically held in the carrier element 72'. So, the height of the housing 71' in the carrier element 72' can be easily adjusted. The carrier element 72' itself is fixed at a respective part 75' of the appliance, e. g. at a door of the same.

As can be seen in FIG. 11, the housing 71' can also bear a lens 73' which is arranged before the free cable end 38' of the light conducting cable 34'. But this is not mandatory; it is also possible that the lens function is integrated into the free cable end 38' of the light conducting cable 34'.

Thus, the housing 71' can be pushed into the desired height position in longitudinal direction L to obtain a sharp display of the information on the floor. So, the projector 81' can be adapted to a specific mounting situation of the domestic appliance in an individual kitchen in an easy way.

It should be emphasized that the different mentioned features specifically in FIG. 1 till 6, FIGS. 7 till 9 and FIGS. 10 till 13, can be combined with another. The figures depict not all discussed features due to clarity.

LIST OF REFERENCE NUMERALS

1 projector
2 outer casing
3 inner casing
4 focusing unit
5 light source, projection element
6 first optical lens unit, projection element
7 information display mask, projection element
8 inner projection window
9 transparent panel
10 primary light beam
10' household appliance
11 fixation element
12 pin, latching element, fixation element
12' housing
13 first focusing position, pin-hole
13' second focusing position, pin-hole
14 outer projection window
14' door
15 second optical lens unit
16 secondary light beam
16' hinges
17 projection surface, floor
18 control unit
18' top plate
19 mirror
20 base casing
20' working surface
21 cap
22 nose
22' frame
23 snap eye
24 recess
24' baseboard
25 connection element
26 household appliance
26' control unit
27 projecting end
28 front door
28' projection device
29 base stand
30' controller
32' light source
34' conducting cable
**34*a*'** conducting cable
**34*b*'** conducting cable
36' conductor
38' free cable end
**38*a*'** free cable end
**38*b*'** free cable end
40' floor area
50' household appliance
60' household appliance
62' connecting member
64' fixing means
66' connecting device
68' extension cable
70' free cable end
71' housing
72' carrier element
73' lens
74' slot
75' part
80' domestic appliance
81' projector
D1 first distance
D2 second distance
D3 third distance
D4 forth distance

The invention claimed is:

1. A projector adapted to be installed on a household appliance, for projecting visible information onto a projection surface lying outside of said household appliance, the projector comprising: a focusing unit that is adapted for focusing a light beam that emanates from a light source onto said projection surface, wherein the focusing unit further comprises at least one fixation element that is adapted to arrange the focusing unit in at least two different focusing positions within said projector; and at least one flexible light conducting cable connected to the at least one light source such that the light emitted from the light source is guided to a free cable end of the light conducting cable, from where it is projected onto the projection field; wherein the free cable end is arranged in a housing, wherein the housing is elastically held within a carrier element and arranged adjustable in a longitudinal direction in the carrier element such that a height of the housing within the carrier element is freely adjustable so as to define different focusing positions.

2. The projector according to claim 1, wherein said different focusing positions of the focusing unit correspond to different distances between said projector and said projection surface, wherein the projector is adapted for being installed on said household appliance in a position and in an orientation that are both adapted for focusing said light beam onto a floor on which said household appliance can be positioned.

3. The projector according to claim 2, wherein said different focusing positions of the focusing unit correspond to different distance positions of said household appliance with respect to said projection surface corresponding to different height positions of said household appliance with respect to said floor.

4. The projector according to claim 1, wherein the at least two different focusing positions of the focusing unit are discrete positions.

5. The projector according to claim 1, wherein the fixation element comprises a latching element for latching the focusing unit at respective discrete focusing positions.

6. The projector according to claim 1, wherein the at least two different focusing positions of the focusing unit are selectable from a preset continuum of focusing positions, wherein the fixation element comprises a guidance device adapted to arbitrarily select the at least two focusing positions from said preset continuum of focusing positions.

7. The projector according to claim 1, further comprising an outer casing that accommodates the focusing unit, wherein the outer casing comprises at least two pin holes that correspond to the different focusing positions of the focusing unit within the projector, wherein said pin holes are adapted to take up said fixation element for fixing the focusing unit in corresponding focusing positions.

8. The projector according to claim 1, wherein the focusing unit comprises an inner casing that accommodates at least one projection element selected from the group comprising a light source, a first optical lens unit comprising at least one focusing lens, and an information display mask comprising a digital information display mask, wherein said inner casing accommodates at least said light source and at least one of said information display mask and/or said first optical lens unit.

9. The projector according to claim 8, further comprising a control unit comprising a printed circuit board, to which at least one projection element is connected for control thereof, the control unit being attached to said inner casing to an outer surface thereof.

10. The projector according to claim 1, further comprising at least one mirror that is tilted with respect to a primary light beam that emanates from the focusing unit, and/or at least one second optical lens unit comprising at least one focusing lens, wherein said mirror is arranged downstream of said focusing unit with respect to said light source and said second optical lens unit is arranged downstream of said mirror.

11. The projector according to claim 7, further comprising an indication element adapted to indicate at the outside of the outer casing the respective focusing position of the focusing unit, wherein the indication element is a pin capable of being arranged alternatively within one of said pin-holes of the outer casing.

12. The projector according to claim 1, wherein a lens is arranged in the housing before the free cable end, and wherein the carrier element has a slot extending in the longitudinal direction.

13. The household appliance comprising the projector according to claim 1, being selected from the group comprising a dishwasher, a washing machine and a baking oven, wherein the projector is installed on a sidewall, behind and/or below a front door, and/or behind and/or below a decorative front door panel of the household appliance.

14. A projector adapted to be installed on a household appliance, for projecting visible information onto a projection surface lying outside of said household appliance, the projector comprising a focusing unit that is adapted for focusing a light beam that emanates from a light source onto said projection surface, wherein the focusing unit further comprises at least one fixation element that is adapted to arrange the focusing unit in at least two different focusing positions within said projector, wherein the at least two different focusing positions of the focusing unit are selectable from a preset continuum of focusing positions, wherein the fixation element comprises a guidance device adapted to arbitrarily select the at least two focusing positions from said preset continuum of focusing positions.

15. The projector according to claim 14, wherein said different focusing positions of the focusing unit correspond to different distances between said projector and said projection surface, wherein the projector is adapted for being installed on said household appliance in a position and in an orientation that are both adapted for focusing said light beam onto a floor on which said household appliance can be positioned.

16. The projector according to claim 15, wherein said different focusing positions of the focusing unit correspond to different distance positions of said household appliance with respect to said projection surface corresponding to different height positions of said household appliance with respect to said floor.

17. The projector according to claim 14, wherein the at least two different focusing positions of the focusing unit are discrete positions.

18. The projector according to claim 14, wherein the fixation element comprises a latching element for latching the focusing unit at respective discrete focusing positions.

19. The projector according to claim 14, further comprising at least one flexible light conducting cable connected to the at least one light source such that the light emitted from the light source is guided to a free cable end of the light conducting cable, from where it is projected onto the projection field.

20. The projector according to claim 19, wherein the free cable end is arranged in a housing, wherein the housing is arranged adjustable in a longitudinal direction in a carrier element.

21. The household appliance comprising the projector according to claim 14, being selected from the group comprising a dishwasher, a washing machine and a baking oven, wherein the projector is installed on a sidewall, behind and/or below a front door, and/or behind and/or below a decorative front door panel of the household appliance.

22. A projector adapted to be installed on a household appliance, for projecting visible information onto a projection surface lying outside of said household appliance, the projector comprising: a focusing unit that is adapted for focusing a light beam that emanates from a light source onto said projection surface, wherein the focusing unit further comprises at least one fixation element that is adapted to arrange the focusing unit in at least two different focusing positions within said projector; and an outer casing that accommodates the focusing unit, wherein the outer casing comprises at least two pin holes that correspond to the different focusing positions of the focusing unit within the projector, wherein said pin holes are adapted to take up said fixation element for fixing the focusing unit in corresponding focusing positions.

23. The projector according to claim 22, further comprising an indication element adapted to indicate at the outside of the outer casing the respective focusing position of the focusing unit, wherein the indication element is a pin capable of being arranged alternatively within one of said pin-holes of the outer casing.

24. The household appliance comprising the projector according to claim 22, being selected from the group comprising a dishwasher, a washing machine and a baking oven, wherein the projector is installed on a sidewall, behind and/or below a front door, and/or behind and/or below a decorative front door panel of the household appliance.

25. A projector adapted to be installed on a household appliance, for projecting visible information onto a projection surface lying outside of said household appliance, the projector comprising: a focusing unit that is adapted for focusing a light beam that emanates from a light source onto said projection surface, wherein the focusing unit further comprises at least one fixation element that is adapted to arrange the focusing unit in at least two different focusing positions within said projector; and an inner casing that accommodates at least one projection element selected from the group comprising a light source, a first optical lens unit comprising at least one focusing lens, and an information display mask comprising a digital information display mask, wherein said inner casing accommodates at least said light source and at least one of said information display mask and/or said first optical lens unit.

26. The projector according to claim 25, further comprising a control unit comprising a printed circuit board, to which at least one projection element is connected for control thereof, the control unit being attached to said inner casing to an outer surface thereof.

27. The household appliance comprising the projector according to claim 25, being selected from the group comprising a dishwasher, a washing machine and a baking oven, wherein the projector is installed on a sidewall, behind and/or below a front door, and/or behind and/or below a decorative front door panel of the household appliance.

28. The projector adapted to be installed on a household appliance, for projecting visible information onto a projection surface lying outside of said household appliance, the projector comprising: a focusing unit that is adapted for focusing a light beam that emanates from a light source onto said projection surface, wherein the focusing unit further comprises at least one fixation element that is adapted to arrange the focusing unit in at least two different focusing positions within said projector; and at least one mirror that is tilted with respect to a primary light beam that emanates from the focusing unit, and/or at least one second optical lens unit comprising at least one focusing tens, wherein said mirror is arranged downstream of said focusing unit with respect to said light source and said second optical lens unit is arranged downstream of said mirror.

29. The household appliance comprising the projector according to claim 28, being selected from the group comprising a dishwasher, a washing machine and a baking oven, wherein the projector is installed on a sidewall, behind and/or below a front door, and/or behind and/or below a decorative front door panel of the household appliance.

* * * * *

UNITED STATES PATENT AND TRADEMARK OFFICE

CERTIFICATE OF CORRECTION

PATENT NO. : 8,870,392 B2
APPLICATION NO. : 13/581106
DATED : October 28, 2014
INVENTOR(S) : Kleinert et al.

It is certified that error appears in the above-identified patent and that said Letters Patent is hereby corrected as shown below:

In the Claims:

Column 17,
Line 21, "focusing tens" should read --focusing lens--.

Signed and Sealed this
Nineteenth Day of May, 2015

Michelle K. Lee

Michelle K. Lee
*Director of the United States Patent and Trademark Office*